United States Patent [19]

Dompas et al.

[11] 3,955,615

[45] May 11, 1976

[54] TWIN-BELT CONTINUOUS CASTING APPARATUS

[75] Inventors: John M. A. Dompas, Olen, Belgium; Robert William Hazelett, Winooski, Vt.

[73] Assignee: Hazelett Strip-Casting Corporation, Winooski, Vt.

[22] Filed: Nov. 11, 1974

[21] Appl. No.: 522,334

Related U.S. Application Data

[62] Division of Ser. No. 401,703, Sept. 28, 1973, Pat. No. 3,865,196.

[52] U.S. Cl. ..... 164/278

[51] Int. Cl.[2] ..... B22D 11/06

[58] Field of Search ..... 164/82, 87, 276, 278, 164/279

[56] References Cited

UNITED STATES PATENTS

| | | | |
|---|---|---|---|
| 2,904,860 | 9/1959 | Hazelett et al. | 164/87 |
| 3,036,348 | 5/1962 | Hazelett et al. | 164/278 |
| 3,509,937 | 5/1970 | Radd | 164/87 |
| 3,747,666 | 7/1973 | Gyongyos | 164/279 |

*Primary Examiner*—Al Lawrence Smith
*Assistant Examiner*—Robert C. Watson
*Attorney, Agent, or Firm*—Parmelee, Johnson & Bollinger

[57] ABSTRACT

Improved casting side dam apparatus for use in twin-belt continuous metal casting machines is described particularly adapted for casting rectangular copper bar providing a casting speed almost double that obtained in prior twin-belt machines and a damblock lifetime which is more than doubled, while producing a more homogeneous and symmetrical casting structure. The side dams are formed by stringing slotted damblocks along the entire length of a flexible metal strap, except for end portions of the strap. An end-to-end weld forms an endless strap loop of accurately predetermined length, and special damblocks having two mating interlocking halves are inserted into the remaining space along the strap, whereby all blocks are free to slide on the strap but with little cumulative space between blocks, which are preferably made of a bronze alloy presenting better resistance to heat cracking and higher heat conductivity than in previous damblocks. During return travel from the output end of the machine to the input, the side dams are passed by tension apparatus which deflects them along a smoothly curved arc convex toward the interior of the side dam loop to take up any available slack, forcing the blocks tightly together in end abutting relationship along the casting zone, thus ensuring a cast product without burrs on the side surfaces. The damblocks are cooled by liquid sprays before re-entry into the machine.

15 Claims, 6 Drawing Figures

TWIN-BELT CONTINUOUS CASTING APPARATUS

This is a division of application Ser. No. 401,703, filed Sept. 28, 1973, now U.S. Pat. No. 3,865,176.

FIELD OF THE INVENTION

The present invention relates to an improved casting side dam apparatus for use in twin-belt casting machines for continuously casting molten metal. In such casting machines, the upper and lower surfaces of a moving mold are defined by a pair of spaced endless flexible casting belts travelling along above and below the mold region. A pair of spaced endless flexible side dams travel along between the casting belts and define the two side surfaces of the moving mold. Each of these side dams is formed by a multiplicity of slotted blocks strung onto a flexible metal strap.

DESCRIPTION OF THE PRIOR ART

In U.S. Pat. No. 2,904,860 edge dams are described comprising blocks of metal or refractory material provided with slots through which is passed a flexible metal strap. After the blocks were placed on the strap, it was welded into a continuous strap to form a side dam, as illustrated in FIG. 2 of that patent.

In accordance with that practice, the straps are difficult to weld with blocks on them, and there was slack in the strap, causing the blocks to be loose. Gaps could occur between loose blocks adjacent to the casting region causing problems with leakage of molten metal into the gaps and producing irregular sides or burrs on the cast product.

In U.S. Pat. No. 3,036,348 the ends of the metal strap are shown in FIG. 16 joined together by screwing them to one of the blocks. Holes were drilled in the ends of the strap, and machine screws were passed through these holes into threaded sockets in this one block. Side dams were thereby made with less slack in the strap. However, the one block to which the ends of the strap were attached was fixed in position on the strap, while all of the other blocks were loose to slide somewhat on the strap. A non-uniform behavior of the travelling side dams resulted due to the fact that one damblock was attached while all of the other damblocks were free to move with respect to the strap. Also, stress was concentrated at the ends of the strap where the screw holes were located tending to cause cracking or failure of the strap at that location.

SUMMARY OF THE INVENTION

In accordance with the present invention, the side dams are constructed by providing a metal strap with slotted damblocks strung onto the strap extending along almost the entire length of the strap. A predetermined small portion of each end of the strap, for example approximately 50 millimeters of each end, remains exposed. The two exposed ends of the strap are welded together to form an endless strap loop of accurately predetermined length. Then the exposed portion of the welded strap is covered with special damblocks formed by fixing two mating interlocking half blocks together with a screw. In this manner, the strap of each side dam is constructed of accurately predetermined length and welded into a continuous loop, and all of the blocks are free to slide on the strap to provide uniform conditions along the entire length of the side dam.

The damblocks are preferably made of a bronze alloy which presents a better resistance to heat cracking and a higher heat conductivity than the nickel-chromium steel damblocks previously used for casting copper. This alloy is "Bronze Corson", a trademark of Usines a Cuivre et a Zinc de Liege, and has a composition of 1.5 to 2.5% Nickel, 0.4 to 0.9% Silicon, 0.1 to 0.3% Iron, 0.1 to 0.5% Chromium, balance Copper.

In the casting machine, the two side dams in travelling along their return path from the output to the input end of the machine are passed over arcuate tension roller apparatus to cause these side dams each to be deflected to travel along a smoothly curved arc which is convex in a direction toward the interior of the side dam loop. Any available slack or spacing between damblocks is taken up by this convex arcuate path curvature which is located away from the casting zone. Thereby the damblocks of both side dams are forced to be thoroughly tight together in end-to-end abutting relationship along the casting zone, thus ensuring a uniform smooth sided cast product without burrs.

In addition, the arcuate tension roller apparatus advantageously serves to take up any slack which develops or accumulates during operation of the machine as a result of stretching of the strap or wearing of the ends of the damblocks. The damblocks thereby remain firmly pressed together in the casting zone during operation regardless of such stretching or wear.

The side dams are cooled to a temperature of approximately 150°C to 200°C by water sprays positioned in the region between the output end of the casting machine and the arcuate tension roller apparatus. By virtue of use of the preferred bronze alloy material to make the damblocks and this cooling before their reentry into the casting zone, the lifetime of the damblocks has more than doubled in casting copper product. Moreover, the cooling of the damblocks and, to a lesser extent, the preferred new damblock material, allow the casting speed for copper bar product to be almost doubled, while providing a more homogeneous and symmetrical cast copper structure than previously obtained.

The various objects, aspects and advantages of the present invention will be more fully understood from a consideration of the following description of a presently preferred embodiment of the invention.

DETAILED DESCRIPTION OF THE DRAWINGS

DETAILED DESCRIPTION

Figures 1, 2:
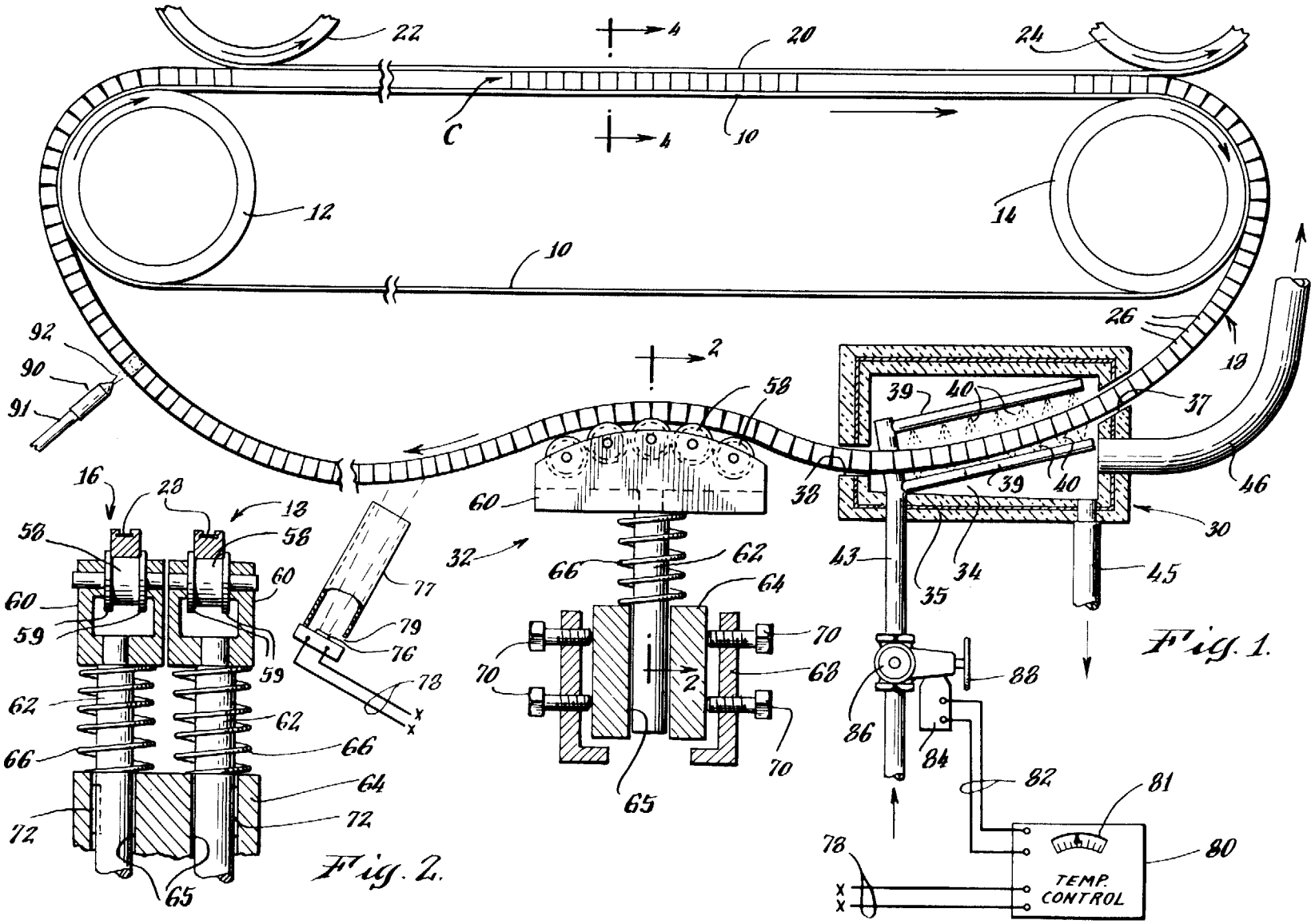
FIG. 1 is a side elevational view of the casting zone, the lower casting belt and one of the side dams in a twin-belt metal casting machine embodying the invention.
FIG. 2 is an enlarged cross-sectional view taken along the plane 2—2 in FIG. 1 showing the tension roller apparatus which maintains the dam blocks firmly pressed one against the other in the casting zone.

In a twin-belt continuous metal casting machine as partially shown in FIG. 1, the lower casting belt 10 is revolved around rolls 12 and 14. The roll 12 is located at the input end of the machine and the roll 14 at the output end. The moving casting mold is defined by the lower casting belt 10, by a pair of spaced side dams 16 and 18 (See also FIG. 4) and by an upper casting belt 20 as they are passed together along through a casting zone C. This upper casting belt 20 revolves around rolls 22 and 24 partially shown in FIG. 1. As the casting belts 10 and 20 are revolved, the two side dams 16 and 18 revolve with the belts, passing through the casting zone C and then returning from the output end to the input end of the machine along a path which is located away from the casting zone, as shown in FIG. 1. Although the casting zone is shown horizontal in FIG. 1, for convenience of illustration, in operation for casting the product described the output end is positioned lower than the input end.

Molten metal, in this example being copper, is introduced into the input end and is solidified to form a cast product P (FIG. 4) which is delivered from the output end of the machine. The cooling of the molten metal in the casting zone is accomplished by the application of high velocity liquid coolant to the casting belts 10 and 20, for example, as explained in U.S. Pat. Nos. 3,036,348 and 3,041,686.

In addition, a very effective cooling action is provided by the side dams 16 and 18 each of which includes a multiplicity of slotted bronze alloy damblocks 26 (FIG. 4) strung on a flexible endless metal strap 28. As the side dams 16 and 18 are returning from the output end of the casting zone, they are passed through weater spray cooling apparatus 30 positioned intermediate the output end and tension roller apparatus 32. This roller apparatus 32 will be explained in detail futher below.

The side dam cooling apparatus 30 includes a cooling chamber 34 surrounded by a metal box 35 and having an entrance and exit openings 37 and 38 for passage of the two side dams through this chamber. Within this chamber 34 there are a plurality of spray manifolds 39 which have orifices for projecting multiple liquid sprays 40 onto the individual damblocks 26. A pipeline 43 supplies the cooling liquid, preferably water, under pressure to the manifolds 39, and a drain pipe 45 drains the liquid from chamber 34. An exhaust duct 46 removes the liquid vapor, e.g. steam which is generated when the sprays 40 strike the hot side dams. The spray cooling apparatus 30 serves to cool the side dams to a temperature hot enough to dry off the water from the damblocks before their re-entry into the input end of the machine, i.e. above the boiling point of water, but not hot enough to harm the coating which may be applied to the damblocks. The damblocks are cooled down below 280°C. but above the boiling point of water, the preferred range being approximately 150°C. to 200°C.

Figures 3, 4, 5, 6:
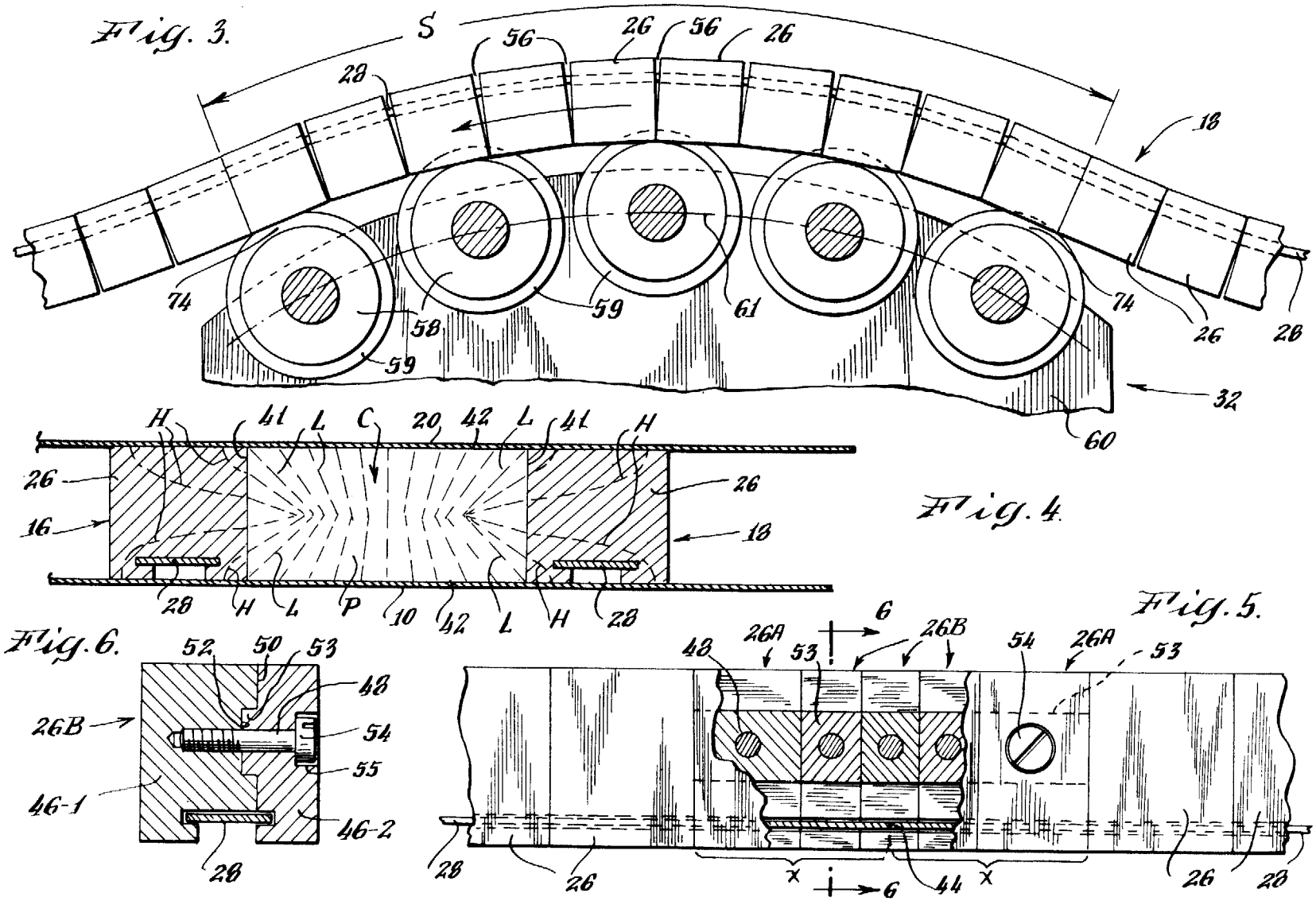
FIG. 3 is an enlargement of a portion of FIG. 1 showing the arcuate tensioning roller apparatus for tightening the damblocks together in the casting zone.
FIG. 4 is an enlarged cross section taken through the plane 4—4 in the casting zone in FIG. 1 illustrating the manner in which the new damblock material and the precooling of the damblocks by water sprays provide a more homogeneous and symmetrical casting structure in the product being cast.
FIG. 5 is an enlarged side elevational view of a portion of a side dam showing the special damblocks which are secured together after the ends of the strap have been welded together.
FIG. 6 is a cross-sectional view taken along the plane 6—6 in FIG. 5 showing the construction of the two mating interlocking half blocks on a strap.

The bronze alloy damblocks 26, preferably of "Bronze Corson" alloy, as described above, have a high heat conductivity. Thus, as shown in FIG. 4, the damblocks conduct heat rapidly away from the two side surfaces 41 of the cast product P. The cooling of the damblocks by the apparatus 30 and, to a lesser extent, the alloy material enable the casting speed to be almost double that previously obtained for similar sizes of cast copper product. Moreover, by virtue of the use of this alloy material and the cooling of the damblocks before their re-entry into the casting zone, the lifetime of the damblocks has been more than doubled in casting copper product.

The rate of heat conduction along the generally indicated heat conduction paths H from the cast side surfaces 41 through the damblocks 26 into the casting belts 10 and 20 is commensurate with the rate at which heat is conducted directly away from the top and bottom surfaces 42 of the cast product P into the casting belts. Because the rates of heat conduction away from the four surfaces 41, 41, 42, 42 of the rectangular cast product P are commensurate with each other, a more homogeneous and symmetrical cast structure is obtained than previously obtained when casting rectangular bar copper sections of similar sizes. The lines L of crystal growth, if any, extend inwardly from the four corners of the cross section at angles of approximately 45° from the surfaces 41 and 42, indicating a symmetrical cast structure. Usually, the crystal structure produced is equiaxial because of the quench effect provided by the good cooling action achieved.

The side dams 16 and 18 are each constructed by sliding the slotted damblocks 26 onto the strap 28. A predetermined small portion X of each end of the strap, for example approximately 50 millimeters of each end, remain exposed. The two exposed strap ends are welded together at a joint 44 which is smoothed by grinding to form an endless strap loop of accurately predetermined length. The yet uncovered portion of the strap loop 28, for example of approximately 100 mm in length, is covered by applying a plurality of special damblocks 26A and 26B each formed by fixing two mating interlocking half blocks 46-1 and 46-2 (FIG. 6) together with a machine screw 48. The blocks 26 may, for example, have a length and width of 40 mm. The height of the damblocks is equal to the height of the cast product, as seen in FIG. 4. When thicker or thinner cast product is desired to be produced, then other side dams having other sizes of dam blocks are used. The two special blocks 26A are of the same cross section as blocks 26 and may, for example, each be approximately 30 mm in length. A plurality of narrower special blocks 26B may be inserted as required to complete filling up the available space on the endless strap loop 28.

The interlocking "half" blocks 46-1 and 46-2 are joined along a longitudinal vertical joint 50, extending perpendicular to the plane of the strap 28. The joint 50 is offset from the center of the composite damblock to be positioned as far away as possible from the hot face, i.e. away from the face toward the casting zone C. A channel or keyway 52 extends longitudinally of the joint surface of one block 46-1 intermediate the slot for strap 28 and the top surface of the block, and a longitudinal ridge or key 53 on the other block 46-2 mates into this keyway. The screw 48 passes horizontally through the key 53 and threads into a socket in one half block, while its head 54 seats in a recess 55 located on the side of the other half block away from the cast product, i.e. away from the hot face.

In order to force the damblocks 26 of both side dams 16 and 18 to be tight together in end-to-end abutting relationship along the casting zone C, the curved tension roller apparatus 32 is provided. This apparatus 32 is located intermediate the cooling apparatus 30 and the input end of the casting zone and serves as deflecting means to deflect the travelling side dams along a smoothly curved path section S (FIG. 3) which is convex in a direction toward the interior of the loop travelled by the side dams. This path section S has sufficient convexity to force wedge-shaped spaces 56 to occur between adjacent damblocks along the convex curve above the tension apparatus 32. The endless strap loop 28 permits all of the damblocks to slide on it. Thus, any available slack among all of the damblocks is accumulated by the spaces 56 along the curve S.

Also, the strap 28 is positioned toward the interior of the side dam loop with respect to the longitudinal centerline of each block. Accordingly, the strap loop is near the widest part of the wedge-shaped spaces 56, and so a relatively short convex inward curve S effectively cumulatively absorbs the available slack space along the remainder of the entire side dam loop forcing blocks tightly together along the casting zone. The rectangular bar product P is thereby cast without burrs. The resulting product is advantageous for use in subsequent rolling to form quality copper rod.

The side tension apparatus 32 includes a plurality of rollers 58 engaging each of the side dams 16 and 18, with means for individually guiding the dams. For example, this guiding means may be flanges 59 on the rollers. A plurality of rollers 58 are mounted at spaced positions along a curve 61 convex upwards on a member 60 having a support pedestal 62 which is free to slide up and down in a bore 65 in a base 64. Springs 66 surrounding the pedestals 62 urge the mounting member 60 upwardly. The base 64 is adjustably secured to framework 68 in the machine by set screws 70. Raising the base 64 applies greater upward spring force on the rollers 58 for adjusting the tension apparatus 32 to press the damblocks more tightly together along the casting zone C. Keying means 72 may be provided to prevent the pedestals 62 from turning in the bores 65 while permitting the pedestals to slide freely up and down. As alternatives to spring actuation of the tension roller apparatus, it is also possible to incorporate counter weight actuation or fluid cylinder actuation into the design of the tension roller apparatus.

The leading and trailing ends of the curve 61 may be curved along a shorter radius than the central portion of this curve, as seen in FIG. 3, to accommodate substantial yet smooth curvature of the side dams while travelling over the tension apparatus 32. Thus, a space 74 may often exist between the travelling side dams and the leading and trailing roller 58. It is normally advantageous to position the tension apparatus 32 closer to the output end of the machine than to the input end to ensure that the side dam loop will consistently hang in a smooth arcuate path between the tension apparatus and the input end. The resulting suspended side dam loops help to pull the damblocks over the tension apparatus and help to maintain a consistent path of travel for the side dams during their return trip from the output end to the input end.

As an example of the advantageous use of this invention, a rectangular copper bar product P is shown having a section 50 mm thick and 110 mm wide (about 2 inches by 4.3 inches) equivalent to 8.6 square inches in cross-sectional area and weighing 31.2 pounds per foot. A casting speed of approximately 36 feet per minute is provided, thus producing 30 metric tons of cast product per hour.

The relatively cool damblocks also serve as heat sinks to help provide a rapid cooling quenching of the cast product as well as serving to conduct heat into the casting belts, as explained further above. In order to control the temperature of these side dams, temperature sensing means 76 are provided connected by electrical leads 78 to a temperature control 80. The temperature sensing means 76 are shown as being radiation responsive and being spaced away from the respective side dams 16 and 18. It is to be understood that there are temperature sensing means for each side dam 16 and 18 for individually controlling their temperatures.

A cylindrical protector and shield 77 protects the infra red radiation responsive sensor 76 which is aimed upwardly at the respective side dam loop which is travelling toward the machine input. This tubular shield 77 may be tilted slightly away from vertical as shown to prevent dirt particles from dropping directly onto the sensor 76. In case any dirt enters the tube shield 77, it may be cleaned through a port 79.

The control 80 may include a gage 81 to indicate the damblock temperature which is maintained above 100°C. but below 280°C., the preferred range being 150°C. to 200°C. for the size of cast copper product described above. Circuit means 82 connect the control 80 to an actuator 84 for controlling a valve 86 which regulates the amount of cooling spray 40 being applied to the respective side dams 16 and 18. Thus, the side dams are cooled to the desired temperature as they approach the input end of the machine. It is understood that there may be separate pipelines 43 and manifolds 39 for cooling each side dam, and a separate actuator 84 and valve 86 individually controls the temperature of each side dam 16 and 18. A manual actuator 88 may be provided so that the valve 86 can be controlled by hand, if desired.

The casting belts 10 and 20 may be coated with a carbonaceous material coating, and the inner faces of the damblocks, i.e. their faces toward the casting zone C, are liquid-spray coated with insulative material by means of a spray nozzle 90. A liquid thermally insulative material is fed through a pipe line 91 to the nozzle 90 to provide a spray pattern 92 which is aimed at the inner faces of the damblocks in both of the side dams 16 and 18. The liquid-spray coating 92 being used in this embodiment is finely divided carbon, for instance lampblack or soot suspended in a quick-drying liquid vehicle, for instance such as trichlorethane. This liquid-spray coating 92 preferably includes a small amount of silicone resin.

The damblocks are above 100°C. but below 280°C. when they issue from the cooling chamber 34. Thus, they are dry of all liquid coolant, e.g. water, before they arrive in position for the spray coating 92. Moreover, fast drying of the damblocks at their controlled temperature permits the liquid-spray coating 92 to dry out and form a dry carbon containing coating on the inner faces of both side dams 16 and 18 before the side dams reenter the input end of the casting zone.

It is noted that the sum of the cross-sectional areas of the copper alloy damblocks in the two side dams in this embodiment of the invention is approximately equal to the cross-sectional area of the copper product being cast. Thus, a highly effective cooling quenching action is provided. In this embodiment, the sum of the cross sections of the two damblocks is 50 square centimeters (about 7.8 square inches) and the cross section of the product is 55 square centimeters (about 8.6 square inches).

We claim:

1. In a twin-belt continuous metal casting machine wherein two spaced side dams revolve in loops passing along opposite sides of a casting zone from its input end to its output end between a pair of revolving casting belts to define a moving mold and wherein the revolving side dams return from the output end to the input end of the casting zone along return paths which are located away from the casting zone, the invention comprising a pair of side dams each including a flexible metal strap loop having a multiplicity of slotted damblocks strung onto said strap, said damblocks on each strap being free to slide longitudinally with respect to the strap, deflecting means being positioned to engage against the respective side dams travelling along said return paths for deflecting the side dams along smoothly curved path sections convex toward the interior of the respective side dam loops, said convex path sections having sufficient convexity for forcing wedge-shaped spaces to occur between the adjacent ends of the damblocks on said convex path sections for tightening the damblocks together in abutting end-to-end relationship along opposite sides of said casting zone to ensure that the metal casting is formed without burrs on the sides adjacent to the side dams.

2. In a twin-belt casting machine, the invention as claimed in Claim 1, in which the strap loop for each side dam is positioned toward the interior of the side dam loop with respect to the longitudinal centerline of each block so that the strap in each side dam is positioned near the widest part of the wedge-shaped spaces on said convex curved path section.

3. In a twin-belt casting machine, the invention as claimed in claim 1, in which said deflecting means include movable mounting means, roller means on said mounting means, and actuating means urging said mounting means toward the interior of the respective side dam loops.

4. In a twin-belt casting machine, the invention as claimed in claim 1, in which a first and second plurality of rollers are arranged along smooth curves on said mounting means for engaging the respective side dams.

5. In a twin-belt casting machine, the invention as claimed in claim 4, in which said smooth curves have greater curvature toward their leading and trailing ends.

6. In a twin-belt casting machine, the invention as claimed in claim 1, in which said damblocks are formed of bronze alloy, and liquid spray cooling means cool the returning damblocks to a temperature of approximately 150°C to 200°C before their re-entry into the input end of the casting zone.

7. Improved side dam apparatus for use in a twin-belt continuous metal casting machine wherein two side dams each revolve in a loop passing along a casting zone from its input end to its output end between a pair of revolving casting belts to define a moving mold and wherein the revolving side dams return from the output end to the input end of the casting zone along a return path which is located away from the casting zone, said improved side dam apparatus comprising a pair of flexible metal straps, each strap having an end-to-end weld therein forming a strap loop, a multiplicity of slotted damblocks strung onto each of said straps and being freely slidable along the strap, and a plurality of special damblocks adjacent one to another on said strap, said special damblocks each including a pair of mating half blocks having a joint between the half blocks, said joint extending longitudinally of the special block and perpendicular to the plane of the strap, and means securing the half blocks together while permitting them to be freely slidable along the strap.

8. Improved side dam apparatus as claimed in claim 7, in which said joint is offset from the center of the special block away from the hot side which is adjacent to the metal being cast and said securing means includes a machine screw extending parallel to the plane of the strap, the head of said machine screw being recessed into the side of the special dam block opposite to the hot side thereof.

9. Improved side dam apparatus as claimed in claim 8, in which one of the half blocks of each special block has a keyway extending longitudinally along the joint and the other half block has a key engaging in said keyway, said machine screw extending through said key.

10. Improved side dam apparatus as claimed in claim 7, in which said damblocks and said special damblocks are formed of bronze alloy.

11. Improved side dam apparatus as claimed in claim 10, in which said bronze alloy has the composition 1.5 to 2.5% Ni, 0.4 to 0.9% Si, 0.1 to 0.3% Fe, 0.1 to 0.5% Cr, balance Cu.

12. Improved side dam apparatus as claimed in claim 7, including tension apparatus having a plurality of rollers mounted on movable mounting means and being arranged along a smooth curve to engage the two side dams travelling along the return path, actuating means urging said movable mounting means to cause said rollers to deflect the side dams along smoothly curved path sections convex toward the interior of the side dam loop, said convex path section having sufficient convexity for forcing wedge-shaped spaces to occur between the adjacent ends of damblocks on said convex path section.

13. Improved side dam apparatus as claimed in claim 12, in which said rollers are arranged along a smooth curve having greater curvature toward its leading and trailing ends then in its central portion.

14. Improved side dam apparatus as claimed in claim 12, including water spray cooling apparatus positioned intermediate the output end of the casting zone and said tension apparatus for directing water sprays onto the damblocks.

15. Improved side dam apparatus as claimed in claim 14, in which said water spray cooling apparatus includes a chamber having entrance and exit openings for passage of the side dams therethrough, a plurality of water spray manifolds located in said chamber directing multiple sprays onto the side dams in the chamber and an exhaust duct for carrying away the steam and water vapor generated when the sprays strike the hot damblocks.

* * * * *